US006302726B1

(12) United States Patent
Marechal

(10) Patent No.: US 6,302,726 B1
(45) Date of Patent: Oct. 16, 2001

(54) RING FOR MARKING WORKING A VOLTAGE OF ELECTRICAL CONNECTION ELEMENT

(75) Inventor: Gilles Marechal, Paris (FR)

(73) Assignee: Societe d'Exploitation des Procedes Marechal (SEPM), Saint Maurice Cedex (FR)

( * ) Notice: Subject to any disclaimer, the term of this patent is extended or adjusted under 35 U.S.C. 154(b) by 0 days.

(21) Appl. No.: 09/424,243

(22) PCT Filed: Mar. 30, 1999

(86) PCT No.: PCT/FR99/00736

§ 371 Date: Nov. 29, 2000

§ 102(e) Date: Nov. 29, 2000

(87) PCT Pub. No.: WO99/52183

PCT Pub. Date: Oct. 14, 1999

(30) Foreign Application Priority Data

Apr. 7, 1998 (FR) ..... 98 04290

(51) Int. Cl.[7] ..... H01R 3/00
(52) U.S. Cl. ..... 439/491; 439/382
(58) Field of Search ..... 439/488, 491, 439/589, 382, 588, 136

(56) References Cited

U.S. PATENT DOCUMENTS 5,139,444 * 8/1992 Garay et al. ..... 439/668
5,449,302 9/1995 Yarbrough et al. .
5,529,513 6/1996 Lee .
5,588,853 * 12/1996 Anthony ..... 439/136
5,641,306 6/1997 Stepniak .
5,951,309 * 9/1999 Hopper ..... 439/142

FOREIGN PATENT DOCUMENTS

2304238 * 12/1997 (GB) .

* cited by examiner

*Primary Examiner*—Brian Sircus
*Assistant Examiner*—Hae Moon Hyeon
(74) *Attorney, Agent, or Firm*—Greenblum & Bernstein, P.L.C.

(57) ABSTRACT

Mechanism for identifying the operating voltage of an electrical connection component mounted on a support. The electrical connection component and the support each comprise a first color and having an outside peripheral interface surface. At least one ring comprises a second color and an outside peripheral surface, the at least one ring being adapted to be inserted between the electrical connection component and the support. The outside peripheral surface is as large as or greater than the outside peripheral interface surface of one of the electrical connection component and the support. At least part of the outside peripheral surface of the at least one ring is visible when the electrical connection component is coupled to the support. The first color is different from the second color.

23 Claims, 3 Drawing Sheets

RING FOR MARKING WORKING A VOLTAGE OF ELECTRICAL CONNECTION ELEMENT

BACKGROUND OF THE INVENTION

1. Field of the Invention

The present invention relates to means for identifying the operating voltage of an electrical connection component. It also relates to a component and electrical connection apparatus fitted with the means.

2. Description of Background and Relevant Information

Electrical connection devices usually comprise two bodies that are coupled together.

This type of device may, for example, comprise an electrical connector having an electrical socket and a plug, or an extension consisting of a movable electrical socket and a plug, or a connector consisting of a socket and a movable plug.

Each body to be coupled comprises a coupling component designed to couple and to connect electrically with the coupling component of the other body. Each body is either in the form of an electrical socket or connector socket mounted on an accessory or support such as a handle, casing, sleeve, or other, machine frame etc.

The electrical characteristics of the two coupling components to be coupled must always be compatible to ensure correct flow of current from one to the other.

To ensure the safety of persons and equipment, these types of coupling components are usually fitted with differentiation and foolproofing means to ensure that only electrically compatible components may be coupled.

Moreover, even where there are no issues of safety, it can be convenient for electrically compatible components to be identified by special markings, in particular by a colour associated with the voltage supplied or received. This type of colour-coding is, in fact, required by certain standards applicable to electrical equipment.

Foolproofing means often require special manufacturing procedures in which the coupling components or parts thereof may, for example, be made of a particular colour conventionally accepted as indicating the electrical characteristics of the component in question.

However, this approach clearly increases production costs.

Furthermore, the means for differentiating the electrical characteristics, as in the devices normally manufactured by the applicant, may depend on a simple angular positioning of the component on which the electrical contacts are fitted. In addition, all the parts are identical for a range of characteristics such that, particularly for obvious reasons related to production and range identification, all the parts are advantageously made the same colour.

If it is nonetheless desired to create a colour differentiation or identification system, simple, effective, permanent means are required that do not necessitate devices being made entirely or partly in a given colour. This problem has been known for some time but has not yet been solved.

Finally, where a particular colour is only assigned to part of a coupling component, for example the protective cover of an electrical socket, the identification conferred by the colour-code is negated if the cover is destroyed and a replacement cover, if one can be found, can cause a risk of confusion between the colours available during repairs.

SUMMARY OF THE INVENTION

The present invention therefore proposes an original identification mechanism for identifying the operating voltage of an electrical connection component mounted on an accessory or support, hereinafter referred to as a "support", that is remarkable in that it utilizes of at least one coloured ring designed to be inserted between the coupling component and its support, the measurements of at least one diameter of the ring being at least as great as that of the coupling component and/or its support in their plane of assembly such as to present a visible annular peripheral surface that, at least in part, is flush with or projects from the coupling component and/or its support.

The ring may, for example, be sandwiched between the two parts of the coupling component and its support when screwed together.

In one embodiment of the invention the ring firstly has an annular zone in the plane of assembly of the coupling component and its support; this ring is gripped between the coupling component and its support. It also has a peripheral edge constituting a visible annular surface under which part of the coupling component and/or its support is inserted. In this situation the inner surface of the peripheral edge is advantageously adjusted to the measurements of that section of the coupling component or its support that is inserted such that the ring may remain in position when the coupling component is connected to or disconnected from its support.

A leaktight seal is usually placed between the coupling component and its support and the ring may advantageously be made at least in part of a material suitable for this function.

Similarly, the ring may alternatively or additionally have another function. It may, for example, include at least a partial projection made of a material suitable for acting as a shock protector.

The ring may also in some cases advantageously comprise at least one protuberance designed to provide shock protection for a projecting section of the coupling component; this may, for example, be a fastening pin provided on one of the components to match a hook on the other component to be coupled to it.

It is clear that the invention also relates to any electrical connection component mounted on an accessory or support an fitted with at least one such ring. It also clearly relates to any electrical connection component comprising two bodies to be coupled together, one of which is provided with an electrical connection component fitted with at least one ring according to the invention since it is clear that the advantage of being able to see the operating voltage of one component is dependent on seeing the other component to which it is to be coupled.

As already stated above, the connection devices may be of various types, in particular an electrical socket and a plug, or a movable electrical socket and a plug, or a connector socket and a movable electrical socket.

BRIEF DESCRIPTION OF THE DRAWINGS

The present invention will be better understood from the following description which refers to the attached figures where.

DETAILED DESCRIPTION OF THE INVENTION

Figure 1:
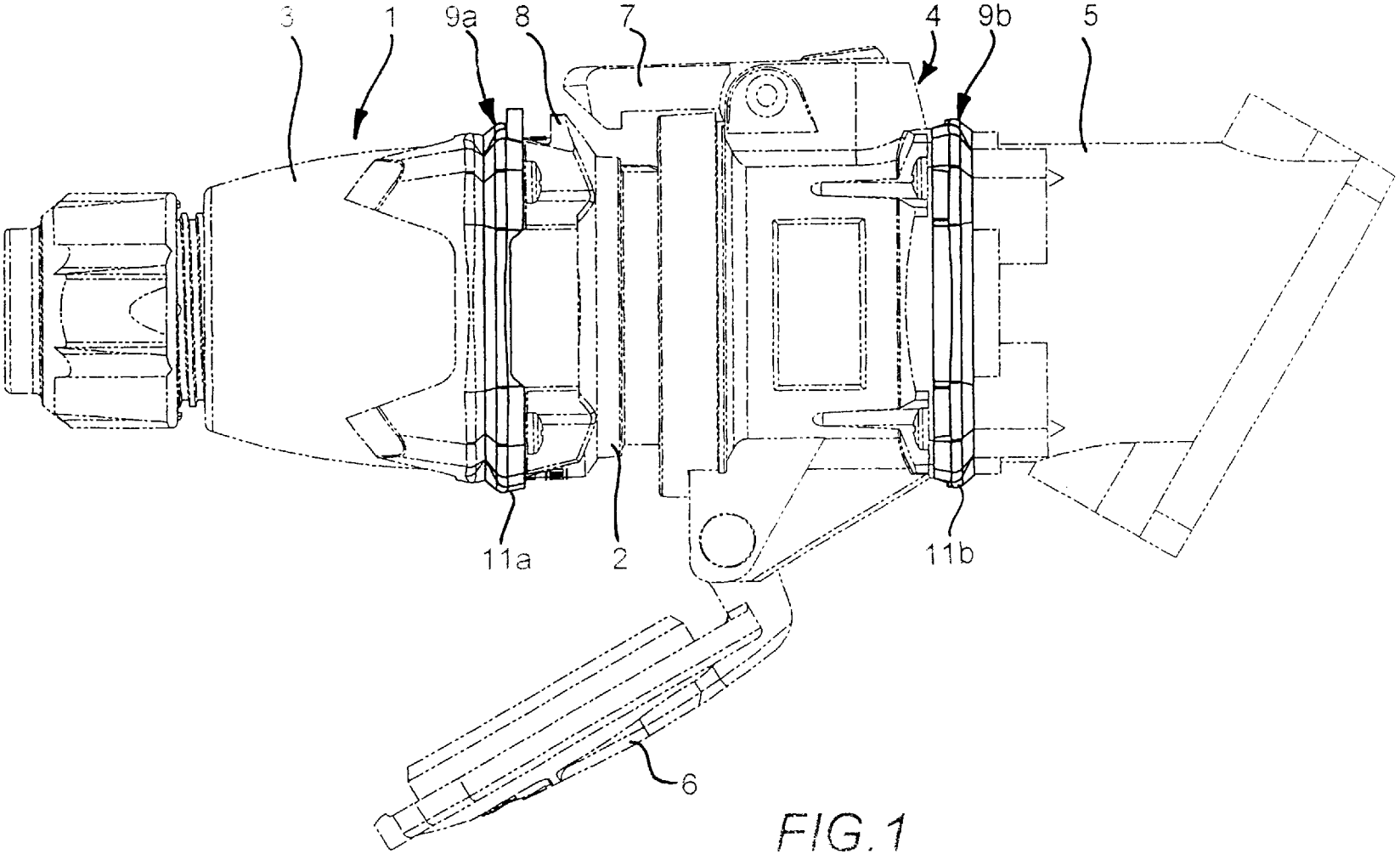
FIG. 1 shows an electrical connection composed of an electrical socket mounted on a casing and a plug fitted with a handle; the plug is shown in the coupled position but only the rings of the invention are shown in unbroken lines in this figure.

The electrical connection shown as an example in the drawings thus comprises a plug 1 composed of a connector socket 2 and a handle 3.

Connector socket 2 constitutes the coupling component of the plug to which handle 3 is here fastened, constituting an accessory or support to which a cable (not shown) is fastened.

Electrical socket 4 is here mounted on a support (in this example a casing 5) which is, for example, designed to be fastened to a wall to constitute a wall-socket.

The word "casing" should be understood in its widest sense may indicate a simple sleeve, unit, distribution cabinet or other.

Using known techniques, connector socket 2 of plug 1 is provided with contacts in the form of pins and electrical socket 4 is provided with matching contacts located in insulating housings the openings of which are normally protected by a rotating safety disk designed to be moved by the pins of the plug.

The electrical socket 4 is also fitted with a cover 6 and a hook 7 designed to fasten onto a pin 8 on connector socket 2 in order to lock the plug 1 and the electrical socket 4 in the coupled connection position.

Figure 2:
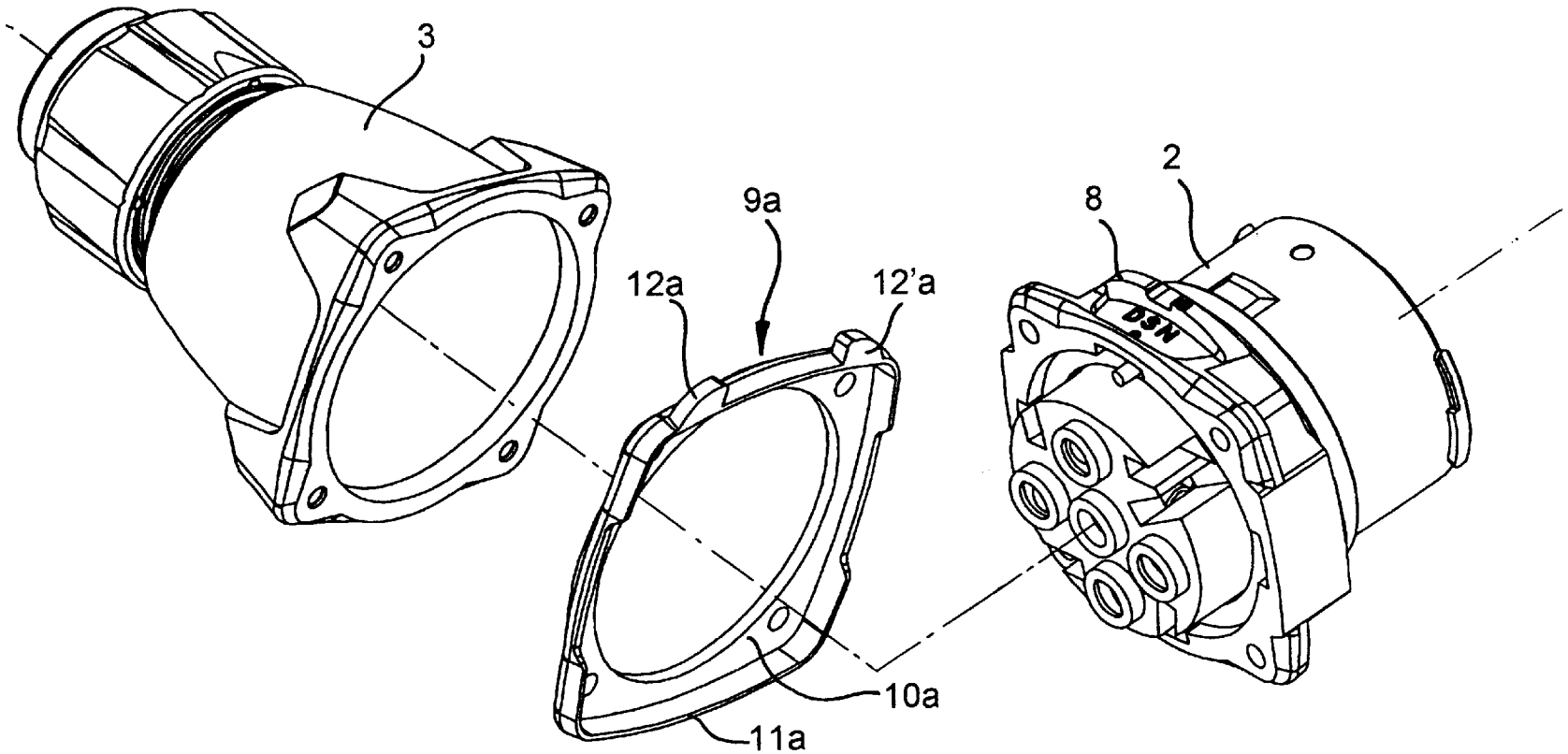
FIGS. 2 and 3 are exploded views along a broken axis of the plug fitted with a handle and the casing-mounted socket of FIG. 1.
Figure 3:
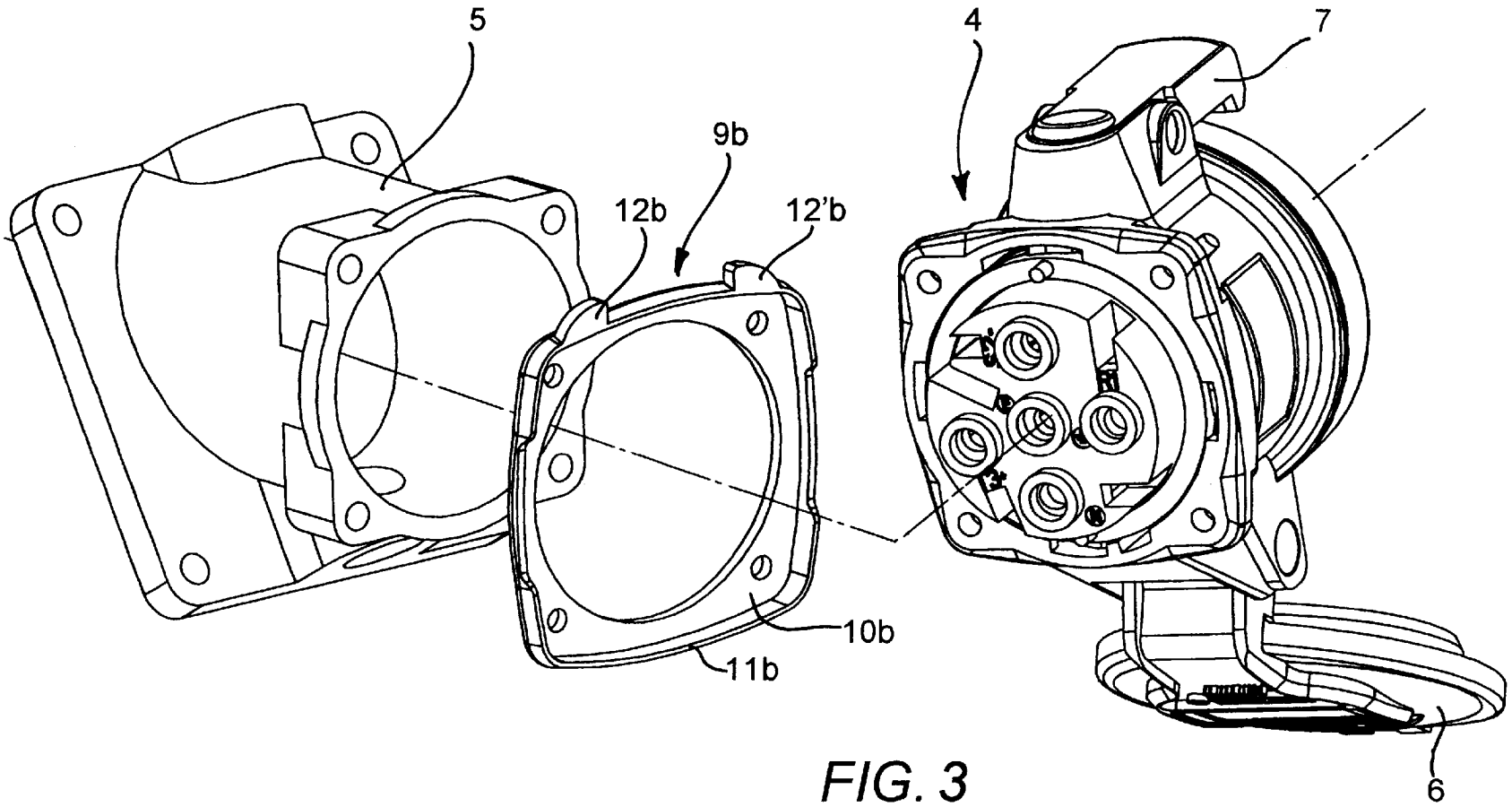

As can be seen from FIGS. 2 and 3, connector socket 2 and handle 3 are coupled together like electrical socket 4 and casing 5.

Parts 2, 3 and 4, 5 are respectively fastened for example by screwing and FIG. 1 clearly shows the screws and the holes in the parts in FIGS. 2 and 3.

Rings 9*a* and 9*b* are inserted between connector socket 2 and handle 3, and are electrical socket 4 and casing 5 respectively and are gripped between the coupled parts as described above.

As can be seen from FIGS. 2 and 3, rings 9*a* and 9*b* are identified by the designs of the interfaces with the parts to be coupled.

Rings 9*a* and 9*b* are the same colour, which is different from the parts themselves which are usually all the same colour.

Each of rings 9*a* and 9*b* has an annular area 10*a*, 10*b* designed to be gripped between the parts to be coupled and an annular peripheral edge 11*a*, 11*b*, under which a section of one of the parts to be coupled is inserted as shown in FIG. 1, namely the rear of the connector socket 2 or electrical socket 4 for rings 9*a* and 9*b* respectively. Peripheral edge 11*a*, 11*b* is advantageously adjusted so that the ring stays in position on the part even though the two parts are not fastened to one another; this facilitates assembly and disassembly and avoids the danger of losing the ring.

As can be seen clearly from FIG. 1, edge 11*a*, 11*b* of the ring constitutes a visible annular surface.

Fitting a ring that can be inserted makes it possible to provide a suitable annular surface that projects slightly from the parts without needing to be too thick.

However, the measurements of the rings may have the same measurements as at least one of the parts in their plane of assembly so that it is flush with at least one part; alternatively, the measurements may be slightly greater so that it projects outwards without, however, having an edge.

A leaktight seal is usually positioned between the parts to be coupled and it is clear that the material used for rings 9*a* and 9*b* may advantageously be chosen to fulfil this function. In other words, the need or usefulness of having a leaktight seal and using this need or usefulness to design a voltage indicator ring, the ring thus having at least two functions, is entirely original.

Moreover, this type of ring may also act as a mechanism for protecting against physical shocks, the material of which it is made being chosen with this in mind.

In some cases protuberances such as 12*a*, 12'*a* and 12*b*, 12'*b* may be included to protect the exposed or protruding parts of one of the components, such as pin 8 on connector socket 2.

Even though in the embodiments shown each component only has one ring, it is clear that several rings may be included, one indicating, for example, a range of nominal operating voltages and the other a range of frequencies. Multicoloured rings could clearly also be used.

As has already been stated, the invention relates not only to the ring but to each coupling component thus equipped and to each device composed of two components to be coupled.

Furthermore, as stated above, where the example shows an electrical connection composed of a plug and an electrical socket, it may be an extension cable (movable electrical socket and plug) or a connector (movable electrical socket and connector socket).

Finally it should be pointed out that the electrical socket or the connector socket may be fastened to a larger assembly than the handle or unit shown, such as a distribution cabinet, machine frame or similar device.

What is claimed is:

1. A mechanism identifying the operating voltage of an electrical connection component mounted on a support, the mechanism comprising:

the electrical connection component and the support each comprising a first color and having an outside surface;

at least one ring comprising a second color and an outside surface, the at least one ring being inserted between the electrical connection component and the support;

the outside surface of the at least one ring comprising at least one of an annular surface and a peripheral surface;

the outside surface of the at least one ring being as large as or greater than the outside surface of one of the electrical connection component and the support;

at least part of the outside surface of the at least one ring being visible when the electrical connection component is coupled to the support, wherein the first color is different from the second color and wherein the electrical connection component is coupled to the support with screws.

2. The mechanism of claim 1, wherein the screws extend through holes disposed in the at least one ring.

3. A mechanism identifying the operating voltage of an electrical connection component mounted on a support, the mechanism comprising:

the electrical connection component and the support each comprising a first color and having an outside peripheral surface;

at least one ring comprising a second color and an outside surface, the at least one ring being inserted between the electrical connection component and the support;

the outside surface being as large as or greater than the outside peripheral surface of one of the electrical connection component and the support;

at least part of the outside surface of the at least one ring being visible when the electrical connection component is coupled to the support, wherein the first color is different from the second color, wherein the outside surface of the at least one ring comprises an annular surface having a peripheral edge, the peripheral edge covering a portion of the outside peripheral surface of one of the electrical connection component and the support.

4. The mechanism of claim 3, wherein the peripheral edge comprises an inner surface for covering a portion of the outside peripheral surface of one of the electrical connection component and the support.

5. The mechanism of claim 3, wherein the peripheral edge comprises at least one protuberance.

6. The mechanism of claim 3, wherein the electrical connection component is coupled to the support with screws.

7. A mechanism identifying the operating voltage of an electrical connection component mounted on a support, the mechanism comprising:

the electrical connection component and the support each comprising a first color and having an outside peripheral surface;

at least one ring comprising a second color and an outside surface, the at least one ring being inserted between the electrical connection component and the support;

the outside surface of the at least one ring comprising at least one of an annular surface and a peripheral surface;

the outside surface being as large as or greater than the outside peripheral surface of one of the electrical connection component and the support;

at least part of the outside surface of the at least one ring being visible when the electrical connection component is coupled to the support, wherein the first color is different from the second color, wherein the at least one ring is made of a material which is adapted to provide a leaktight seal between the electrical connection component and the support.

8. A mechanism identifying the operating voltage of an electrical connection component mounted on a support, the mechanism comprising:

the electrical connection component and the support each comprising a first color and having an outside peripheral surface;

at least one ring comprising a second color and an outside surface, the at least one ring being inserted between the electrical connection component and the support;

the outside surface of the at least one ring comprising at least one of an annular surface and a peripheral surface;

the outside surface of the at least one ring being as large as or greater than the outside peripheral surface of one of the electrical connection component and the support;

at least part of the outside surface of the at least one ring being visible when the electrical connection component is coupled to the support, wherein the first color is different from the second color, wherein the at least one ring is made of a material which is adapted to provide shock protection.

9. A mechanism identifying the operating voltage of an electrical connection component mounted on a support, the mechanism comprising:

the electrical connection component and the support each comprising a first color and having an outside peripheral surface;

at least one ring comprising a second color and an outside surface, the at least one ring being inserted between the electrical connection component and the support;

the outside surface of the at least one ring comprising at least one of an annular surface and a peripheral surface;

the outside surface of the at least one ring being as large as or greater than the outside peripheral surface of one of the electrical connection component and the support;

at least part of the outside surface of the at least one ring being visible when the electrical connection component is coupled to the support, wherein the first color is different from the second color, and wherein the support comprises an accessory.

10. A mechanism identifying the operating voltage of an electrical connection component mounted on a support, the mechanism comprising:

the electrical connection component and the support each comprising a first color and having an outside diameter surface;

at least one ring comprising a second color and an outside diameter surface, the at least one ring being inserted between the electrical connection component and the support;

the outside diameter surface being as large as or greater than the outside diameter surface of one of the electrical connection component and the support;

at least part of the outside diameter surface of the at least one ring being visible when the electrical connection component is coupled to the support;

the outside diameter surface of the at least one ring comprising an annular surface having a peripheral edge, the peripheral edge covering a portion of the outside diameter surface of one of the electrical connection component and the support, wherein the first color is different from the second color.

11. The mechanism of claim 10, wherein the peripheral edge comprises an inner surface for covering a portion of the outside diameter surface of one of the electrical connection component and the support.

12. A mechanism identifying the operating voltage of an electrical connection component mounted on a support, the mechanism comprising:

the electrical connection component and the support each comprising a first color and having an outside diameter surface;

at least one ring comprising a second color and an outside diameter surface, the at least one ring being inserted between the electrical connection component and the support;

the outside diameter surface being as large as or greater than the outside diameter surface of one of the electrical connection component and the support;

at least part of the outside diameter surface of the at least one ring being visible when the electrical connection component is coupled to the support;

the outside diameter surface of the at least one ring comprising an annular surface having a peripheral edge comprising at least one protuberance, wherein the first color is different from the second color.

13. A mechanism identifying the operating voltage of an electrical connection component mounted on a support, the mechanism comprising:

the electrical connection component and the support each comprising a first color and having an outside diameter surface;

at least one ring comprising a second color and an outside diameter surface, the at least one ring being inserted between the electrical connection component and the support;

the outside diameter surface of the at least one ring comprising at least one of an annular surface and a peripheral surface;

the outside diameter surface being as large as or greater than the outside diameter surface of one of the electrical connection component and the support;

at least part of the outside diameter surface of the at least one ring being visible when the electrical connection component is coupled to the support;

the at least one ring being made of a material which is adapted to provide a leaktight seal between the electrical connection component and the support, wherein the first color is different from the second color.

14. A mechanism identifying the operating voltage of an electrical connection component mounted on a support, the mechanism comprising:

the electrical connection component and the support each comprising a first color and having an outside diameter surface;

at least one ring comprising a second color and an outside diameter surface, the at least one ring being inserted between the electrical connection component and the support;

the outside diameter surface of the at least one ring comprising at least one of an annular surface and a peripheral surface;

the outside diameter surface being as large as or greater than the outside diameter surface of one of the electrical connection component and the support;

at least part of the outside diameter surface of the at least one ring being visible when the electrical connection component is coupled to the support;

the at least one ring being made of a material which is adapted to provide shock protection, wherein the first color is different from the second color.

15. A mechanism identifying the operating voltage of an electrical connection component mounted on an support, the mechanism comprising:

one of the electrical connection component and the support comprising a first color and an annular peripheral surface;

at least one ring comprising a second color and an annular or a peripheral surface, the at least one ring being inserted and trapped between interface surfaces of the electrical connection component and the support;

the annular or the peripheral surface of the at least one ring being as large as or greater than the annular peripheral surface of one of the electrical connection component and the support;

the at least one ring being visible when the electrical connection component is coupled to the support;

wherein the first color is different from the second color and identifies the operating voltage, and wherein the electrical connection component is coupled to the support with screws.

16. The mechanism of claim 15, wherein the screws extend through holes disposed in the at least one ring.

17. A mechanism identifying the operating voltage of an electrical connection component mounted on an support, the mechanism comprising:

one of the electrical connection component and the support comprising a first color and an annular peripheral surface;

at least one ring comprising a second color and an annular or a peripheral surface, the at least one ring being inserted and trapped between interface surfaces of the electrical connection component and the support;

the annular or the peripheral surface of the at least one ring being as large as or greater than the annular peripheral surface of one of the electrical connection component and the support;

the at least one ring being visible when the electrical connection component is coupled to the support;

wherein the first color is different from the second color and identifies the operating voltage, and wherein the annular or the peripheral surface of the at least one ring comprises a peripheral edge, the peripheral edge covering a portion of the annular peripheral surface of one of the electrical connection component and the support.

18. The mechanism of claim 17, wherein the peripheral edge comprises an inner surface for covering a portion of the annular peripheral surface of one of the electrical connection component and the support.

19. The mechanism of claim 17, wherein the peripheral edge comprises at least one protuberance.

20. The mechanism of claim 17, wherein the electrical connection component is coupled to the support with screws.

21. A mechanism identifying the operating voltage of an electrical connection component mounted on an support, the mechanism comprising:

one of the electrical connection component and the support comprising a first color and an annular peripheral surface;

at least one ring comprising a second color and an annular or a peripheral surface, the at least one ring being inserted and trapped between interface surfaces of the electrical connection component and the support;

the annular or the peripheral surface of the at least one ring being as large as or greater than the annular peripheral surface of one of the electrical connection component and the support;

the at least one ring being visible when the electrical connection component is coupled to the support;

wherein the first color is different from the second color and identifies the operating voltage, and wherein the at least one ring is made of a material which is adapted to provide an leaktight seal between the electrical connection component and the support.

22. A mechanism identifying the operating voltage of an electrical connection component mounted on an support, the mechanism comprising:

one of the electrical connection component and the support comprising a first color and an annular peripheral surface;

at least one ring comprising a second color and an annular or a peripheral surface, the at least one ring being inserted and trapped between interface surfaces of the electrical connection component and the support;

the annular or the peripheral surface of the at least one ring being as large as or greater than the annular peripheral surface of one of the electrical connection component and the support;

the at least one ring being visible when the electrical connection component is coupled to the support;

wherein the first color is different from the second color and identifies the operating voltage, and wherein the at least one ring is made of a material which is adapted to provide shock protection.

23. A mechanism identifying the operating voltage of an electrical connection component mounted on an support, the mechanism comprising:

one of the electrical connection component and the support comprising a first color and an annular peripheral surface;

at least one ring comprising a second color and an annular or a peripheral surface, the at least one ring being inserted and trapped between interface surfaces of the electrical connection component and the support;

the annular or the peripheral surface of the at least one ring being as large as or greater than the annular peripheral surface of one of the electrical connection component and the support;

the at least one ring being visible when the electrical connection component is coupled to the support;

wherein the first color is different from the second color and identifies the operating voltage, and wherein the support comprises an accessory.

* * * * *